United States Patent [19]

Dugge

[11] 4,114,785

[45] Sep. 19, 1978

[54] CONTROL VALVE FOR BOTTOM DISCHARGE OUTLET

[75] Inventor: Richard H. Dugge, St. Louis, Mo.

[73] Assignee: ACF Industries, Incorporated, New York, N.Y.

[21] Appl. No.: 775,892

[22] Filed: Mar. 9, 1977

[51] Int. Cl.[2] ..... B61D 7/02; B65G 53/40

[52] U.S. Cl. ..... 222/545; 105/283; 222/556; 251/305; 302/52

[58] Field of Search ..... 251/299, 300, 305; 105/247, 250, 280, 283; 222/556, 545; 302/52

[56] References Cited

U.S. PATENT DOCUMENTS

| | | | |
|---|---|---|---|
| 2,769,403 | 11/1956 | Cox | 222/556 X |
| 3,296,980 | 1/1967 | Fritz | 105/283 X |
| 3,482,741 | 12/1969 | Fritz | 105/280 X |
| 3,700,143 | 10/1972 | Shaver et al. | 302/52 X |
| 3,876,261 | 4/1975 | Jucius, Jr. et al. | 302/52 |

FOREIGN PATENT DOCUMENTS

| | | | |
|---|---|---|---|
| 1,198,272 | 12/1959 | France | 251/305 |
| 1,472,745 | 3/1967 | France | 251/305 |

*Primary Examiner*—David A. Scherbel

*Attorney, Agent, or Firm*—Henry W. Cummings

[57] ABSTRACT

A discharge outlet for attachment to the bottom of a hopper which has a longitudinally extending discharge opening between spaced inner edges of the outlet side walls. An elongate control valve is mounted for rotation about a horizontal axis in the discharge opening between a pair of longitudinally extending parallel seats on opposed sides of the valve, and the control valve has its axis of rotation closer to one side of the control valve than to its other side whereby from a closed position weight of lading on the valve urges the valve in one direction of rotation to an open position in which lading is discharged about both sides of the control valve. The control valve includes a body portion extending longitudinally in the discharge opening, and a moment portion extending transversely and eccentrically relative to the axis of rotation of the body portion. The body portion includes a body portion edge which in closed position engages or is closely adjacent to a body portion valve seat located on or attached to the near side wall. The weight of the lading acting on the eccentrically mounted portion creates a moment about the control body portion which reduces the torque required to move the control valve to the open position.

38 Claims, 14 Drawing Figures

CONTROL VALVE FOR BOTTOM DISCHARGE OUTLET

BACKGROUND OF THE INVENTION

U.S. Pat. Nos. 3,778,114 and 3,876,261 describe outlets in which a valve segment is movable relative to a fixed discharge trough to allow lading to enter the discharge trough during unloading of the outlet. However, if the outlet is impacted in transit, occasionally the valve segment will become wedged against the housing and the outlet will be difficult or impossible to unload. Furthermore in the outlet described in these patents an unloading conduit is attached to a cylindrical end portion of the valve element, and both the unloading hose and the valve element must be rotated during unloading. In some cases the unloading hose is heavy, making rotation of the valve during unloading difficult for the operator.

In U.S. Pat. No. 3,693,839 a pneumatic outlet is disclosed in which a horizontally movable element is mounted in the upper portion of the discharge trough, and is thus less subject to becoming jammed due to impacting of the outlet. The outlet is provided with a transverse partition which divides the outlet into longitudinally spaced compartments and horizontally movable valve elements are provided in each compartment, each activated by a separate rack and pinion operator. Longitudinally extending shafts are attached to each valve operator which extend to opposite ends of the outlet where handles are attached to provide opening and closing of each valve element from either end of the outlet. However this outlet requires transversely extending shaft seals for the rack and pinion operator, which along with the rack and pinion operator makes, the outlet expensive.

In U.S. Pat. No. 3,663,066 a valve is segment shaped. However, the lading acting on the valve tends to maintain the valve in closed position, rather than assisting the operator in opening the valve.

U.S. Pat. No. 998,393; 2,789,739 and 2,919,158 are examples of eccentrically mounted valve members used in pneumatic outlets. However in these arrangements the eccentric mounting does not assist the operator in moving the valve member toward the open position.

U.S. Pat. 3,420,501 discloses a butterfly valve having a body portion and plate portions extending on opposite sides of the body portion. However since the plate portions are of equal width, the lading weight acting on the respective plate portions results in a counterbalancing effect and no reduction in operating torque necessary to open the valve is achieved. The patent states (column 4) the weight of lading tends to rotate the valve into closed rather than open position.

U.S. Pat. No. 1,949,555 discloses a gravity outlet used in a combination hopper and box car in which an unloading door is eccentrically mounted relative to its operating shaft, and in which the opposite edge of the door seats on a ledge located at the opposite side of the discharge opening. The door is connected to the operating shaft with a cam which allows the door to be displaced laterally from the ledge for lading unloading. In this arrangement the door is connected to the operating shaft outside of the discharge opening and a counter weight is attached to the operating shaft which engages an externally mounted stop when the valve member reaches the open position. However the connection between the door and the operating shaft located externally of the outlet, and the counter weight mounted externally of the outlet significantly increases the likelihood of damage to the operation of the outlet in transit. The cam mounting of the door relative to the operating shaft to move the door laterally relative to the ledge is difficult and expensive to fabricate. Furthermore if the operating shaft and/or counter weight were impacted, the door could get stuck in the closed position, preventing unloading of the car.

SUMMARY OF THE INVENTION

A container outlet is provided for use on railway hopper cars, overland hopper trucks and/or intermodel hopper containers. The outlet includes a pair of side walls which extend downwardly, and the lower ends of the side walls define an outlet discharge opening.

An elongate control valve is mounted for rotation about a horizontal axis in the discharge opening between a pair of longitudinally extending parallel seats on opposed sides of the valve, and the control valve has its axis of rotation closer to one side of the control valve than to its other side whereby from a closed position weight of lading on the valve urges the valve in one direction of rotation to an open position in which lading is discharge about both sides of the control valve.

The control valve includes a body portion and a moment portion extending transversely and eccentrically relative to the axis of rotation of the body portion. The body portion includes a body portion edge which in closed position engages or is located closely adjacent to a body portion valve seat located on or attached to the near side wall. A moment portion valve seat is located on or attached to the opposite side wall, transversely spaced from the control valve. The moment portion includes a moment portion edge which in closed position seats on or closely adjacent to the moment portion valve seat.

The moment portion extends eccentrically from the body portion a distance sufficient to define a moment portion moment arm about the longitudinal axis of the body portion. The force of gravity acting on the lading to be unloaded applied upon the moment portion creates a moment about the longitudinal axis of the body portion. The downward inclination of the moment portion determines that the moment acting on the moment portion is in the direction to cause rotation of the control valve from the closed to an open position. Thus the torque necessary to rotate the valve from the closed to the open position is less than would be the case without the eccentric mounting.

The control valve is rotatably movable from a closed position in which the body portion edge is located on or closely adjacent to the body portion valve seat, and the moment portion edge is located on, or closely adjacent to the moment portion valve seat; and an open position wherein lading may pass through a first control valve discharge opening between the body portion and the body portion valve seat, and a second control valve discharge opening between the control valve and the moment portion valve seat during discharge. Open position stop means may be provided which engage when the control valve assumes the full open position.

The body portion is preferably symmetrical about its longitudinal axis such that lading forces due to gravity acting on the body portion on either side of its longitudinal axis are generally balanced, resulting in little, if any, tendency to rotate the control valve in either direction.

The moment developed by the lading acting on the moment portion is preferably approximately equal to or greater than the sum of the weight of the lading opposing rotation of the body portion, the force of friction between the lading and the valve opposing rotation of the body portion toward open position, to facilitate opening the control valve. Closed position stop means are provided which engage when the control valve is rotated into the closed position.

The body portion is preferably segment shaped with the juncture of the lower surface of the segment and the upper surface of the segment defining the body portion edge. If the body portion is segment shaped, the closed position stop means may take the form of the body portion segment edge engaging the body portion valve seat. The segment may be curved including a segment of a circle, ellipse or parabola. Less preferably it may be a segment of a polygon in which the upper surface comprises a series of flat plates.

The upper surface of the body portion is preferably curved to reduce the force of the lading opposing rotation of the valve to be primarily one of friction between the valve and the lading opposing rotation, rather than a force necessary to lift or shear lading to rotate the valve.

The moment portion valve seat preferably includes a moment portion valve seat extension of sufficient length to allow rotation of the control valve to move the body portion edge from the closed position to a metering position relative to the body portion valve seat, while at the same time the moment portion edge remains in engagement with, or closely adjacent to the moment portion valve seat extension. This metering position allows a controlled amount of lading to be discharged substantially entirely through the first control valve discharge opening only.

A control shaft is attached to at least one end of the control valve body portion along the longitudinal axis thereof and extends through an end wall where a handle is attached to rotate the valve between closed and open and/or metering positions. A second control shaft may be attached to a second end of the body portion which extends through an opposite end wall and a handle attached to operate the valve from the opposite end of the outlet. The open position and closed position stop means may also take the form of lugs mounted on the external surface of the end walls engaging the handles in closed position.

A resilient device may be provided engaging at least one of the first and second control shafts which tends to prevent rotation of the shaft. The resilient devices may comprise Belleville springs and they may be mounted in one of the end walls. The resilient devices may be adjusted such that the force opposing rotation of the shaft is approximately equal to the force tending to open the valve resulting from the lading acting on the moment portion, less the force resulting from the weight of the lading opposing rotation of the control valve and the frictional force forces opposing rotation of the valve toward open position.

A pair of longitudinally spaced control valves may be provided in elongated outlets. If desired a transverse partition may be provided dividing the outlet into longitudinally spaced compartments. Preferably the control valves are transversely spaced and the body portion valve seats in the respective unloading compartments are located on or attached to opposite side walls; and the moment portion valve seats in each compartment are located respectively on or attached to opposite side walls.

A pair of control shafts may be attached to each control valve along the longitudinal axis of the control valve body portion, each control shaft extending to opposite ends of the outlet, so that each control valve may be operated from either end of the outlet.

In one embodiment the control shafts extending through the outlet to the end wall farthest away from the control valve pass through a hollow portion in the moment portion valve seat to avoid the control shaft constituting an obstruction where lading could hang up during pneumatic unloading, and to protect the control shaft from impacts applied to the outlet.

For use of the outlet for pneumatic discharge, a pneumatic discharge trough is attached to the lower inner ends of the side walls which extends below the outlet discharge opening, longitudinally of the outlet beyond at least one and preferably beyond both of the opposite outlet end walls. The discharge trough includes a lower cylindrical discharge portion and may include upper, transversely extending through shoulders on each side of the discharge trough. One or both of these shoulders may define the body portion valve seat and/or the moment portion valve seat.

THE DRAWINGS

DESCRIPTION OF PREFERRED EMBODIMENTS

The outlet of the present invention may be used on railway hopper cars, overland hopper trucks and/or intermodel transit hopper containers.

Figure 1:
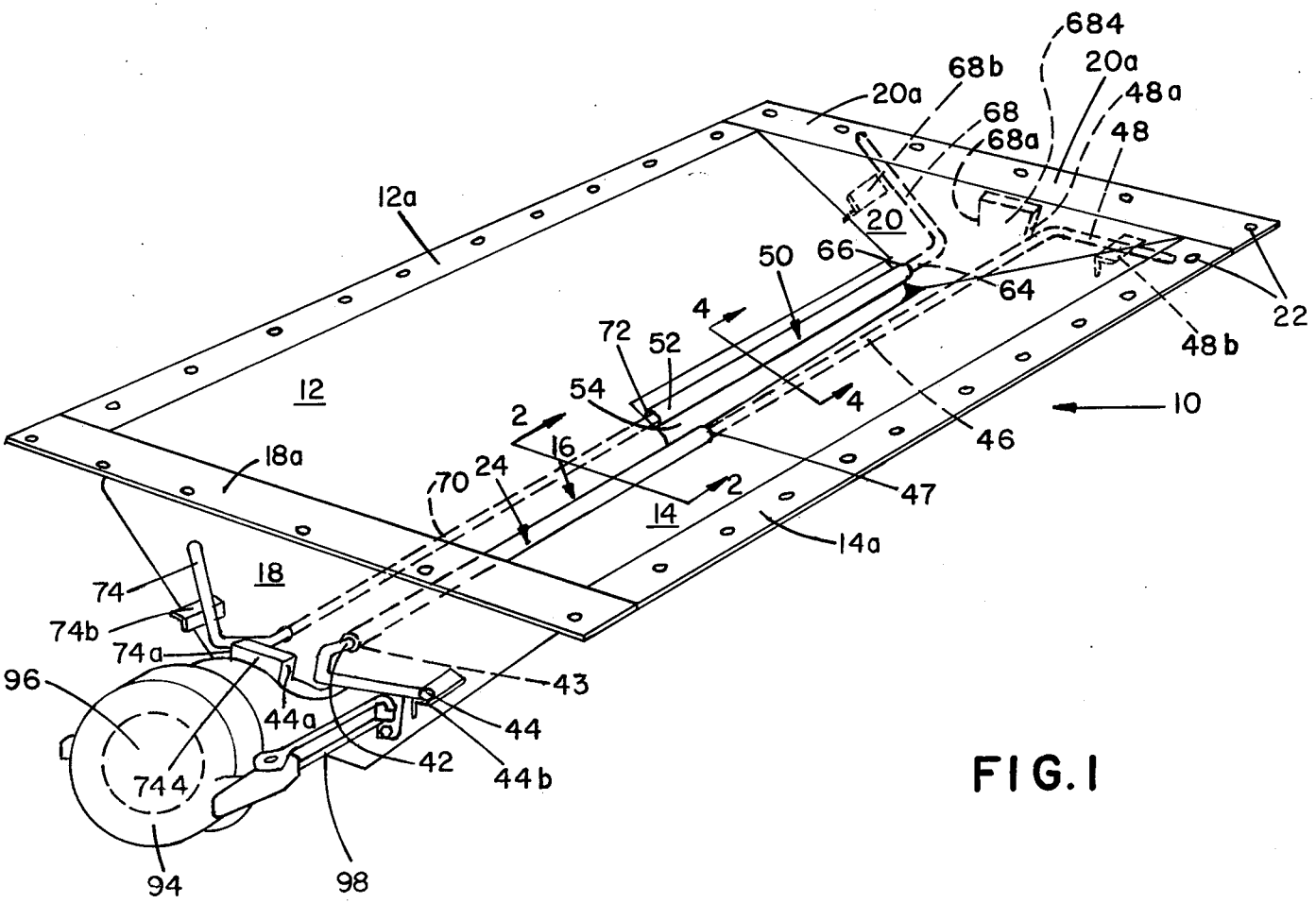
FIG. 1 is a perspective view of the container outlet of the present invention.
Figure 12:
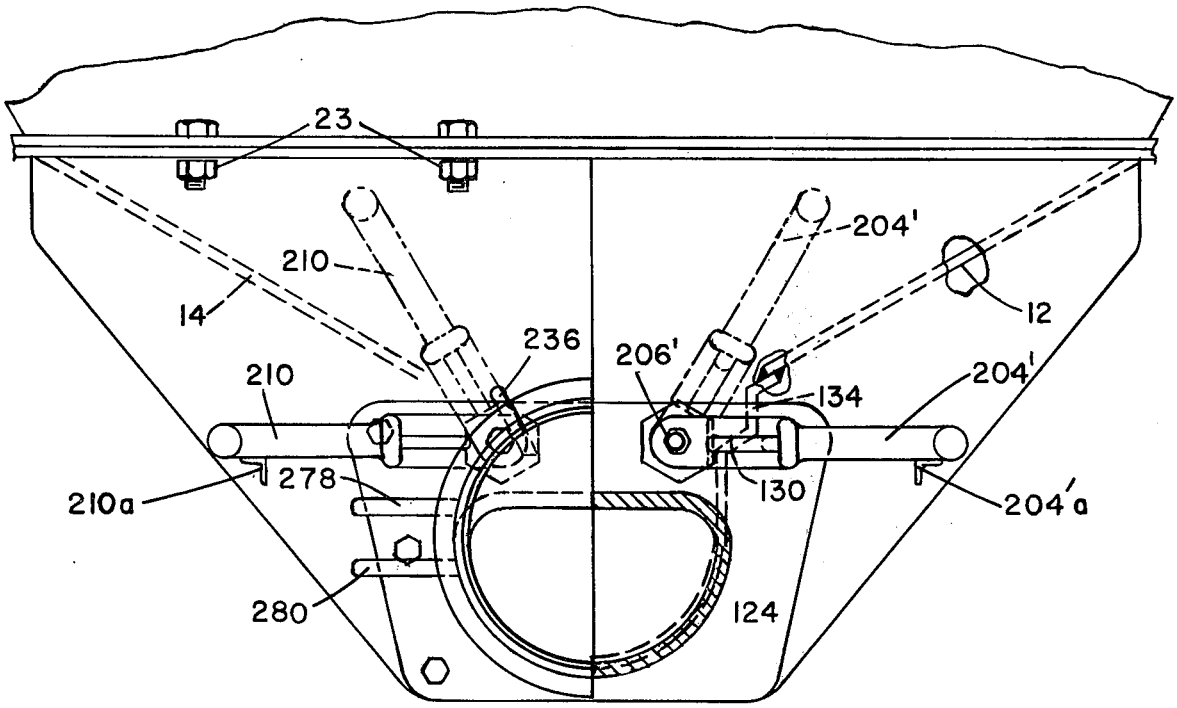
FIG. 12 is a view partially in section looking in the direction of the arrows along the line 12—12 in FIG. 9.

The outlet indicated generally at 10 includes a pair of side walls 12 and 14 each having an upper flange 12*a* and 14*a* for attachment of the outlet to the hopper car, truck or hopper container. The side walls are attached to vertically extending, longitudinally spaced outlet end walls 18 and 20 (FIG. 1). End walls 18 and 20 each having upper mounting flanges 18*a* and 20*a*. The sidewall and end wall flanges include openings 22 for attaching the outlet to a hopper car, truck or container with fasteners 23 (FIG. 12). The side walls 12 and 14 extend downwardly from the respective flanges 12*a* and 14*a*, and the lower inner ends 12*b* and 14*b* of side walls 12 and 14 define an outlet discharge opening 16 (FIGS. 2–5).

Figure 2:
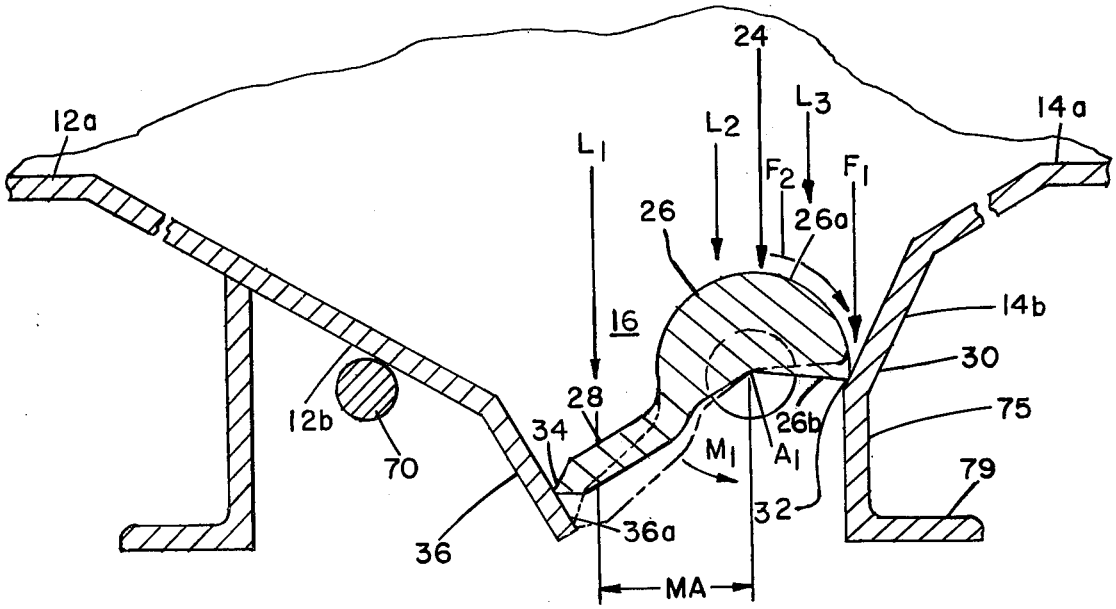
FIG. 2 is a sectional view looking in the direction of the arrows along the line 2—2 in FIG. 1, and also showing in phantom the metering position of the control valve.

A control valve 24 is rotatably mounted within the discharge opening 16 adjacent the inner end of one of the side walls; in FIG. 2, adjacent side wall inner end 14*b*. The control valve includes a body portion 26 and a moment portion 28 extending transversely and eccentrically from the body portion. The body portion 26 is preferably shaped as a segment of a curved body such as a segment of a circle, parabola or an elipse or a segment of a multisided polygon such as a hexagon or an octagon. In FIG. 2 body portion 26 is illustrated as a segment of a circle. If the body portion is a segment of a circle, it preferably forms an arcuate segment of at least about 60 degrees (60°). The juncture of the upper surface 26*a* and the lower surface 26*b* define a body portion edge 30. The body portion edge in closed position seats on or closely adjacent to a body portion valve seat 32 located on the inner end 14*b* of the adjacent side wall 14. The moment portion 28 includes a moment portion edge 34 which in closed position seats on or closely adjacent to a moment portion valve seat 36 located on the opposite side wall as a continuation of or extension of side wall inner end 12*b*. If the body portion is formed from a segment of an arc, the moment portion preferably includes an outwardly extending flat portion integral with the arcuate segment extending eccentric to the longitudinal axis of the body portion.

The moment portion 28 extends eccentrically from the body portion 26 a distance sufficient to define a moment portion moment arm MA about the longitudinal axis $A_1$ of the body portion 26 as shown in FIG. 2. The force of gravity acting on the lading $L_1$ to be unloaded applied upon the moment portion 28 creates a moment $M_1$ about the longitudinal axis $A_1$ of the body portion. The downward inclination of the moment portion determines that the moment $M_1$, acting on the moment portion, is in the direction to cause rotation of the control valve 24 from the closed to an open position. Thus the torque necessary to rotate the valve from the closed to the open position is less than would be the case without the eccentric mounting.

The body portion 26 is preferably symmetrical about the axis $A_1$ such that lading forces $L_2$ and $L_3$ due to gravity acting on the body portion on either side of the axis $A_1$ are generally balanced, resulting in little tendency to rotate the control valve in either direction.

The control valve 24 is rotatably movable from a closed position in which the body portion edge 30 is seated on or closely adjacent to the body portion valve seat 32 and the moment portion edge 34 is seated on or closely adjacent to the moment portion valve seat 36 to prevent significant amounts of lading from passing through discharge opening 16; and an open position (shown in FIG. 3) wherein lading may pass through a first control valve discharge opening 38 between the body portion 26 and the body portion valve seat 32, and a second control valve discharge opening 40 between the body portion 26 and the moment portion valve seat 36.

As mentioned above the body portion may be made of a segment of a polygon, in which a small amount of lading is displaced when the control valve moves to open position and the force $F_1$ (FIG. 2) due to the weight of the lading would be overcome as the valve is rotated and the body portion moves vertically away from the body portion valve seat 32.

Closed position stop means are provided which engage when the control valve is rotated into the closed position. The stop means may take the form of the body portion edge 30 engaging the body portion valve seat 32. However other closed position stops may be provided within the scope of the present invention, as discussed hereinafter.

The upper surface of body portion 26 is preferably a curved segment close to a circular segment so that in moving to the open position the control valve displaces little or no lading to substantially avoid the force $F_1$ resulting from the weight of the lading opposing rotation of the valve.

However, even if the upper surface of the body portion 26 is symmetrical and curved, the lading acting on the body portion due to the lading weight illustrated at $L_2$ and $L_3$ creates a force of friction $F_2$ acting in a direction opposite to the direction of rotation of the control valve in moving from closed to open position.

The length of moment arm MA of moment portion 28 is preferably made of sufficient length that the moment portion moment $M_1$ is approximately equal to or greater than the forces $F_1$ (if present) and $F_2$ opposing rotation of the valve toward the open position.

Resilient control means to be described hereinafter are preferably provided to insure that the moment $M_1$ of the lading acting on the moment portion 28 will not open the valve unless the operator rotates the valve in a direction to move the valve into the open position.

In accordance with another feature of the present invention moment portion valve seat 36 preferably includes an extension 36*a* (FIG. 2) or is constructed of sufficient length, that rotation of the control valve 24 will move the body portion edge 30 from the closed position engaging or closely adjacent to body portion valve seat 32, to a metering position spaced from body portion valve seat allowing lading to pass through first control valve discharge opening 38 while at the same time the moment portion edge 34 remains in engagement with or closely adjacent to moment portion valve seat extension 36*a*, shown in phantom in FIG. 2, and thus prevent significant amounts of lading discharge through control valve discharge opening 40. Thus this metering position allows effective control and metering of the amount of lading being discharged through the first control valve opening 38.

To rotate the control valve 24 between the closed and open and/or metering positions a control shaft 42 is rigidly attached to a first end 43 control valve 24 (FIG. 1). Control shaft 42 passes through the adjacent end wall 18, through a conventional bearing provided therein (not shown) and is provided with a handle 44 to rotate shaft 42 and control valve 24 between the closed, open and/or metering positions.

If a single control valve is utilized in the outlet, the opposite end of the control valve 24 is provided with a second shaft which is provided in a suitable bearing (not shown) in the opposite end wall. If desired a handle (not shown) may also be attached to the single control shaft to operate the valve from the opposite end of the outlet.

However for outlet applications requiring long discharge openings, for example in outlets extending transversely of railway cars, a second control valve 50 is provided in the outlet, longitudinally spaced from first control valve 24 as shown in FIG. 1. A second control shaft 46 is attached to the opposite end 47 of control valve 24. Shaft 46 extends through opposite end wall 20 through a suitable bearing mounted therein (not shown) and a handle 48 provided to operate control valve 24 from the opposite end of the outlet.

Figure 4:
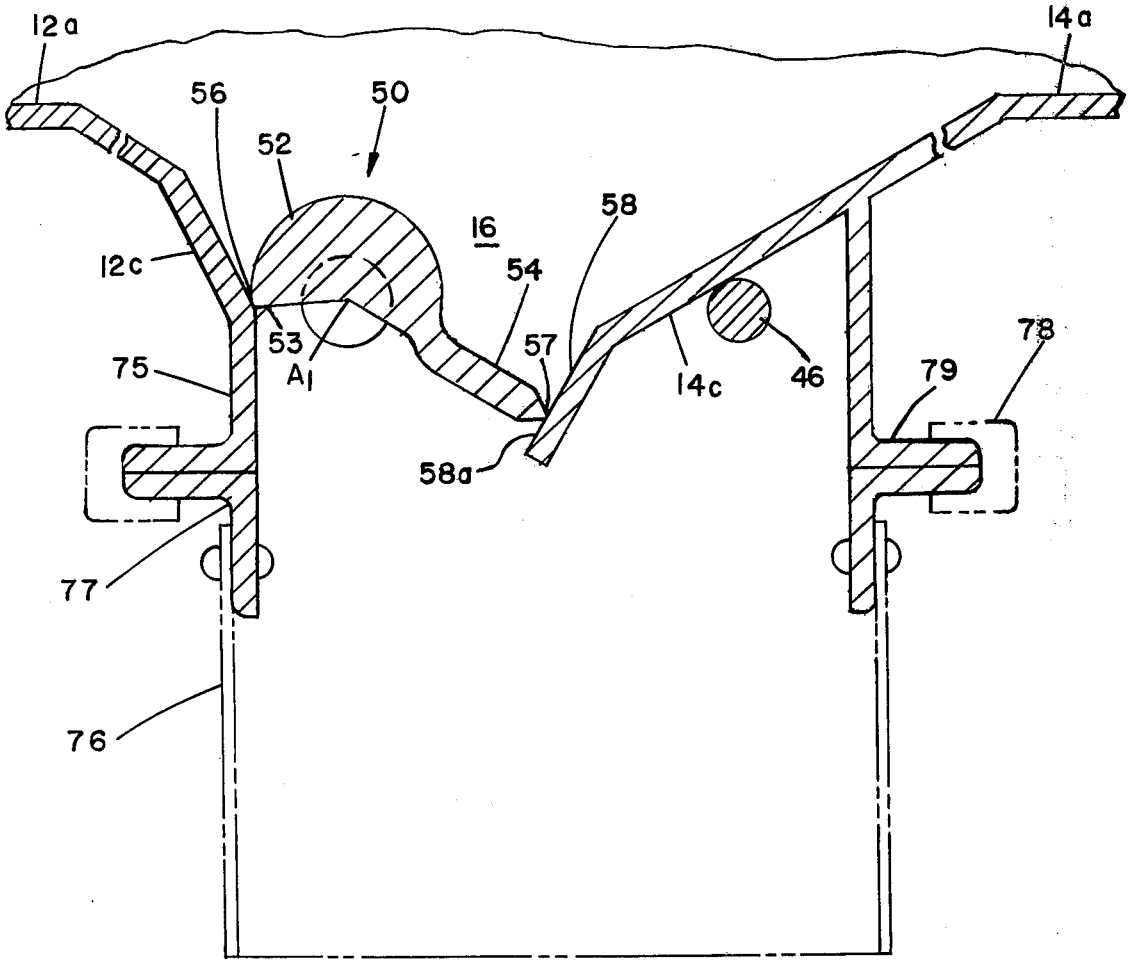
FIG. 4 is a sectional view looking in the direction of the arrows along the line 4—4 in FIG. 1, and also illustrating the use of the outlet for gravity discharge through an unloading boot.
Figure 5:
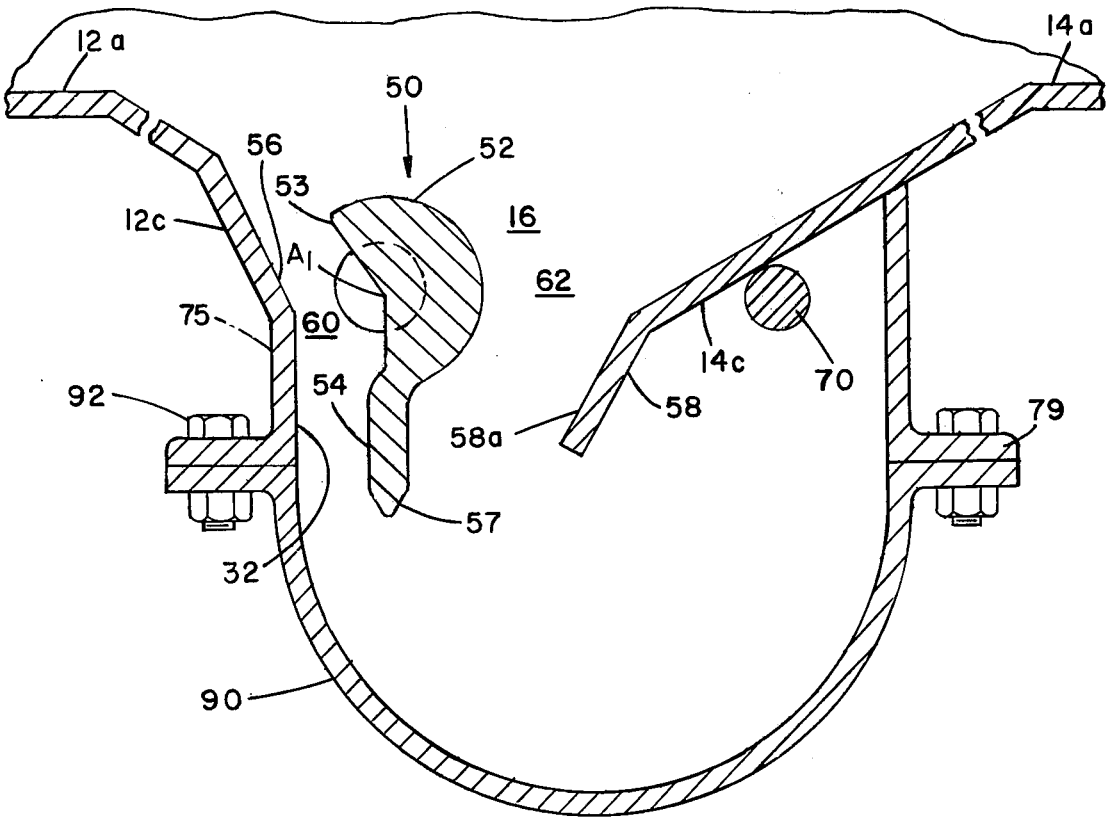
FIG. 5 is a view similar to FIG. 4 illustrating the control valve in open position, and but illustrating a pneumatic discharge trough attached to the lower portion of the outlet.

Control valve 50 is preferably constructed in the same manner as control valve 24, including a body portion 52, FIG. 4, of segment shape having a body portion edge 53 and a moment portion 54 extending transversely and eccentrically relative to body portion 52 having a moment portion edge 57. However it is preferred that body portion 52 be located adjacent the opposite side wall from the side wall adjacent body portion 26; adjacent the inner end **12*c* of side wall 12. A body portion valve seat 56 is provided on the inner end 12*c* of side wall 12. Inner end 14*c* includes a continuation or extension of side wall 14 which defines a moment portion valve seat 58. It will be noted that side walls 12 and 14 are constructed such that the respective side wall inner ends 12*c* and 14*c* in FIG. 4 are transversely spaced from side wall inner ends 12*b* and 14*b* in FIG. 2**.

Valve seat 58 also preferably includes a moment portion valve seat extension **58*a* so that body portion 52 may be moved into a metering position to allow lading to discharge through a third control valve discharge opening 60 (FIG. 5, similar to the position shown in phantom in FIG. 2) while moment portion 54 remains seated on or closely adjacent to valve seat extension 58*a* preventing significant amounts of lading discharge. In the full open position shown in FIG. 5 lading may discharge through third control valve discharge opening 60, and through fourth control valve discharge opening 62 between moment portion valve seat 58 and control valve body portion 52**.

A third control shaft 64 (FIG. 1) is attached to a first end 66 of control valve 50, which shaft extends through adjacent end wall 20 and through a suitable bearing (not shown) and is provided with an operating handle 68 to operate control valve 50 from this end of the outlet. A fourth control shaft 70 is attached to a second end 72 of control valve 50. Shaft 70 extends longitudinally adjacent but transversely spaced from control valve 24 (FIGS. 2 and 3) below side wall **12*b*, and then through end wall 18 and a bearing (not shown). Shaft 70 is provided with a handle 74 to operate control valve 50 from the near end of the outlet as shown in FIG. 1**.

Open position stops **44*a*, 48*a*, 68*a* and 74*a* may be provided on the external surface of end walls 18 and 20 (FIG. 1) which the handles 44, 48, 68 and 74 engage when the control valves reach the full open position. It will be apparent that stops 44*a* and 74*a* comprise a single lug 744 welded to end wall 18 and stops 48*a* and 68*a* comprise a single lug 684 welded to end wall 20. Furthemore, the closed position stop means may comprise stops 44*b*, 48*b*, 68*b* and 74*b* attached to the external surface of end walls 18 and 20** which the handles engage when the control valve assumes the closed position. Including such closed position stop means is particularly advantageous when the body portion does not engage the body portion valve seat in closed position.

A depending outlet mounting portion 75 is provided. A suitable unloading boot 76 (shown in FIG. 4) riveted to an angle 77 may be temporarily attached with clamps 78 to a depending outlet mounting portion flange 79 to assist in directing the lading during gravity unloading.

The outlet of the present invention may also be used for pneumatic unloading. For pneumatic unloading a pneumatic discharge conduit 90 (FIGS. 3 and 5) may be attached to mounting portion flanges 79 with fasteners 92. The pneumatic discharge conduit extends longitudinally of the outlet below at least one end wall 18 (FIG. 1), and preferably below both end walls 18 and 20. A cap 94 covers a discharge connection 96 where a conduit is removably attached to pneumatically convey lading to be unloaded to a container (not shown) by vacuum suction or positive pressure in a known manner. Air for pneumatic unloading may be provided by a pressure line attached to the container containing the lading, or by removing a cap covering a discharge opening at the opposite end of the discharge conduit. Instead of welding lugs 744 and 684 to the end walls, these lugs may be welded or integrally attached to the upper external surface of discharge conduit 90. A suitcase type latch 98 mounted on end wall 18 for maintaining cap 94 in place is provided when the outlet is not being unloaded.

During unloading, control valves 24 and/or 50 is/are rotated by means of one or more of handles 44, 74, 48 and 68 to the open and/or metering position. If stops **44*a*, 48*a*, 68*a* and 74*a* are provided, the handles engage these stops in the full open position. The lading acting on moment portions 28 and/or 54 creates a moment which assists the operator in moving the valve 24 and/or 50 to the metering and/or open position shown in FIGS. 3 and 5. During gravity unloading, the lading drops downwardly through boot 76 into a container (not shown). During pneumatic unloading the lading is conveyed through a conduit attached to discharge conduit 90 to a container (not shown). After unloading valve 24 and/or 50 is returned to the closed position with moment portion 28 and 54 engaging or closely adjacent to respective moment portion valve seats 36 and/or 58. If closed position stops 44*b*, 48*b*, 68*b* and 74*b*** are provided the handles engage these stops when the control valve(s) assumes the closed position.

Another embodiment of the outlet of the present invention particularly adapted for pneumatic discharge is illustrated in FIGS. 6–15 of the drawings.

Figure 6:
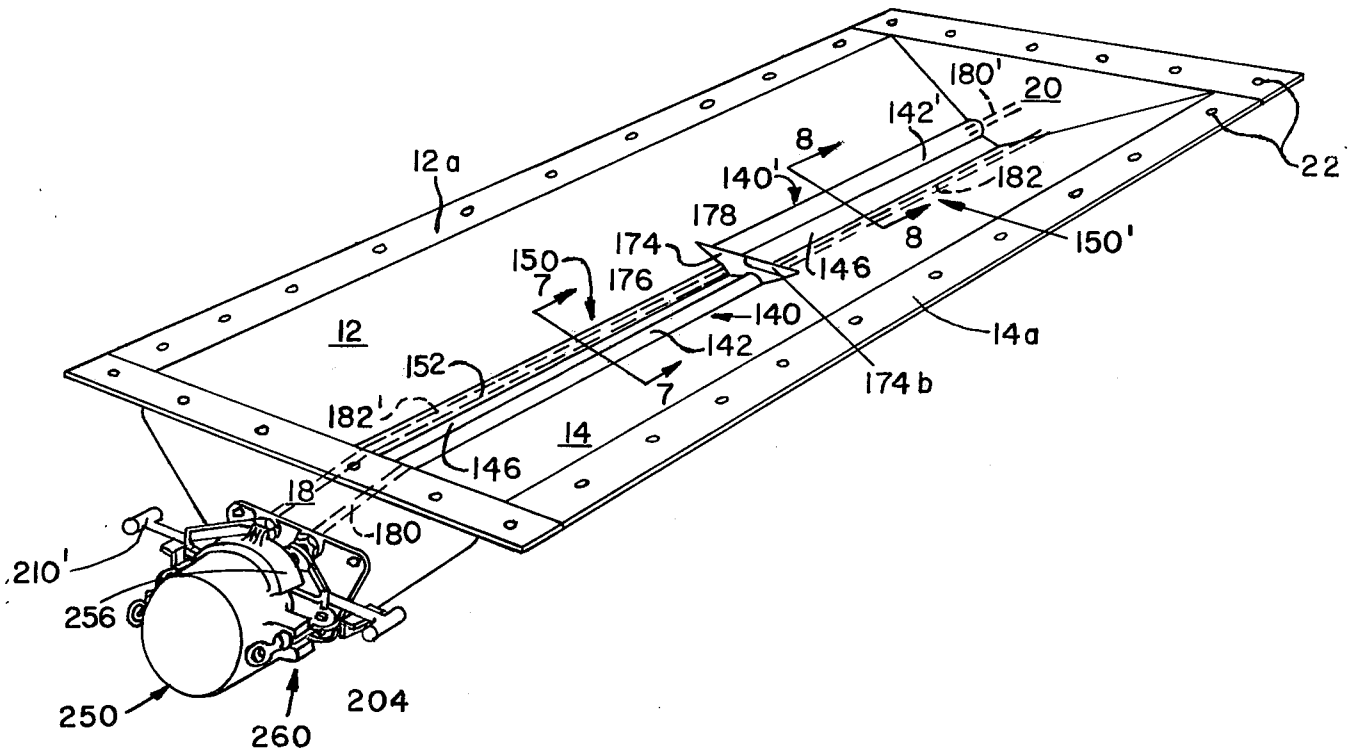
FIG. 6 is a perspective view of another embodiment of the container outlet of the present invention particularly adapted for pneumatic discharge.
Figure 7:
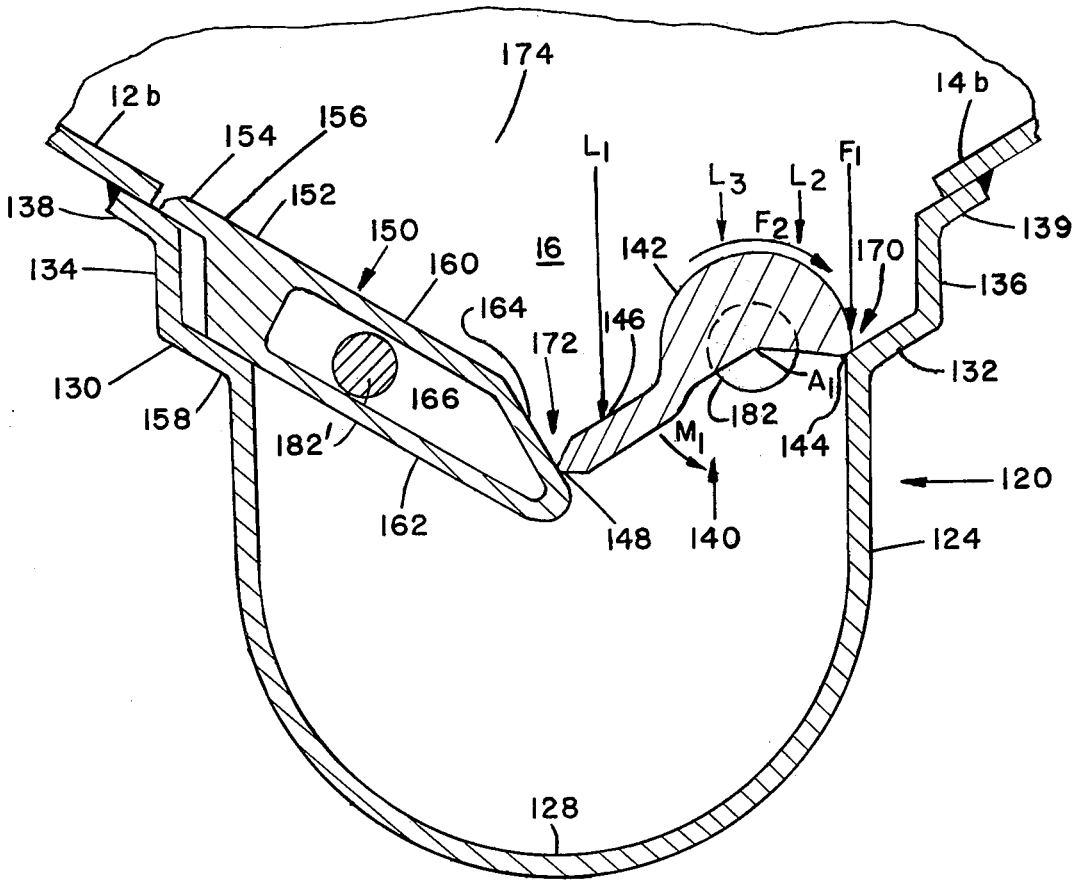
FIG. 7 is a view looking in the direction of the arrows along the line 7—7 in FIG. 6.

A discharge trough 120 (FIG. 7) is attached to the lower inner ends **12*b* and 14*b* of the side walls which extends below the outlet discharge opening 16, longitudinally of the outlet beyond the opposite outlet end walls 18 and 20 (FIG. 6). The discharge trough includes a lower, cylindrical discharge portion 124 and a pair of upper, transversely extending trough shoulders 130 and 132, one located on each side of the discharge trough (FIG. 7). Preferably shoulders 130 and 132 are inclined downwardly and inwardly as shown in FIG. 7 from respective trough vertical portions 134 and 136. Upper flanges 138 and 139 are provided for attachment of the discharge trough to the respective inner ends 12***b* and 14*b*, for example, by welding.

A control valve 140 is rotatably mounted within the discharge opening 16 adjacent one of the trough soulders. In FIG. 7, control valve 140 is mounted adjacent trough shoulder 132. Control valve 140 includes a body portion 142 of circular segment shape having a body portion edge 144 which in closed position seats on or closely adjacent to shoulder 132. Thus trough shoulder 132 constitutes a body portion valve seat. A moment portion 146 extends eccentrically and transversely downwardly from the body portion 142 having a moment portion edge 148.

A moment portion valve seat 150 is mounted on the opposite trough shoulder 130 in FIG. 7, transversely spaced from control valve 140. Moment portion valve seat 150 includes a mounting portion 152 having an upper mounting flange 154 which rests on discharge trough flange 138. Mounting portion 150 further includes a first inclined mounting surface 156 which engages or is located closely adjacent to trough vertical portion 134, and a second inclined mounting surface 158 resting on trough shoulder 130. Valve seat 150 is preferably hollow and includes an upper transverse leg 160 and a lower transverse leg 162 extending from mounting portions 152, which legs are attached to and support an inclined moment valve seat portion 164. A longitudinally extending valve seat opening 166 is defined by mounting portion 152, legs 160 and 162, and moment valve seat portion 164. In closed position moment portion edge 148 seats on or closely adjacent to moment valve seat portion 164.

Figure 3:
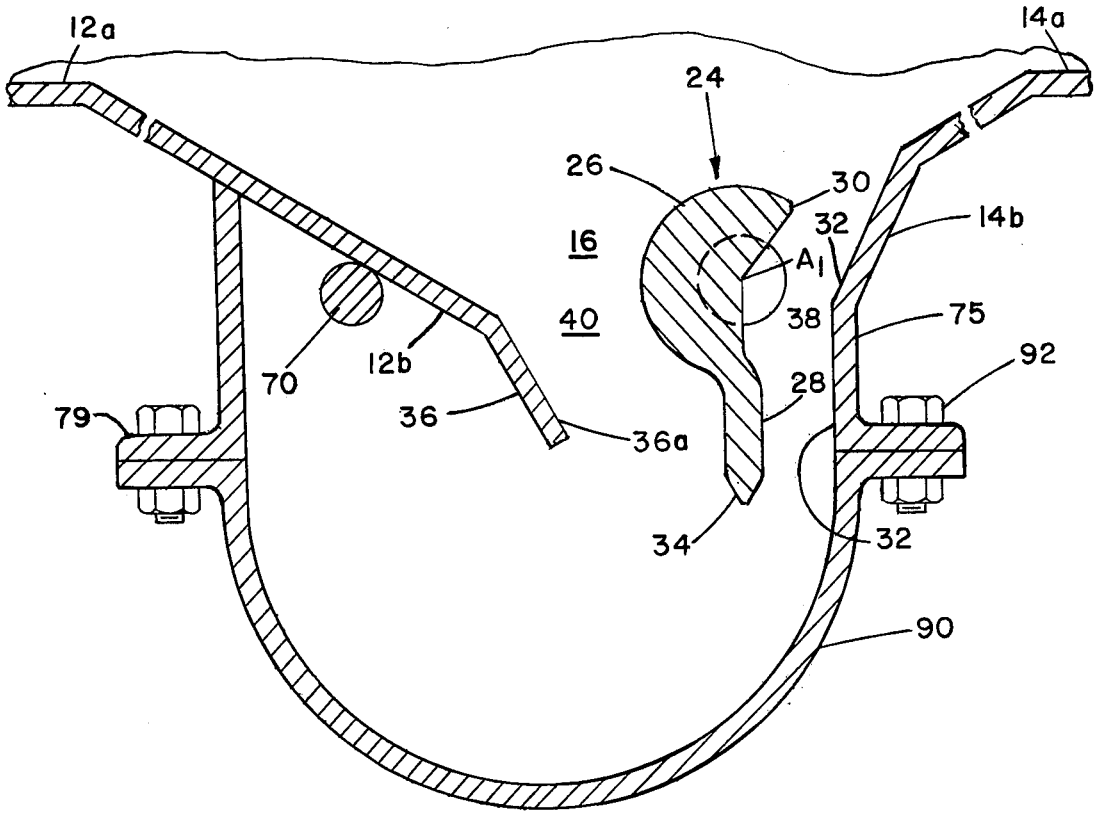
FIG. 3 is a sectional view similar to FIG. 2 illustrating the control valve in the full open position and also illustrating a pneumatic discharge trough attached thereto.

The control valve 140 is rotatably movable from the closed position, in which the body portion edge 144 is seated on or closely adjacent to trough shoulder body portion valve seat 132 and the moment valve seat portion 164, and an open position in which moment portion 146 extends generally downwardly similar to FIG. 3 and wherein lading may pass through a first control valve discharge opening 170 (FIG. 7) between body portion 142 and the shoulder body portion valve seat 132, and a second control valve discharge opening 172 between body portion 142 and moment valve seat portion 164, into the discharge trough 120.

A transverse outlet partition 174 joins the side walls 12 and 14 at about the longitudinal mid portion of the outlet to divide the outlet into longitudinally spaced unloading compartments 176 and 178 defined by side walls 12 and 14, partition 174, and the respective end walls 18 and 20. As shown in the cutaway portion of FIG. 10, upper surfaces 174*a* and 174*b* are tapered in the direction of respective unloading compartments 178 and 176.

Figure 8:
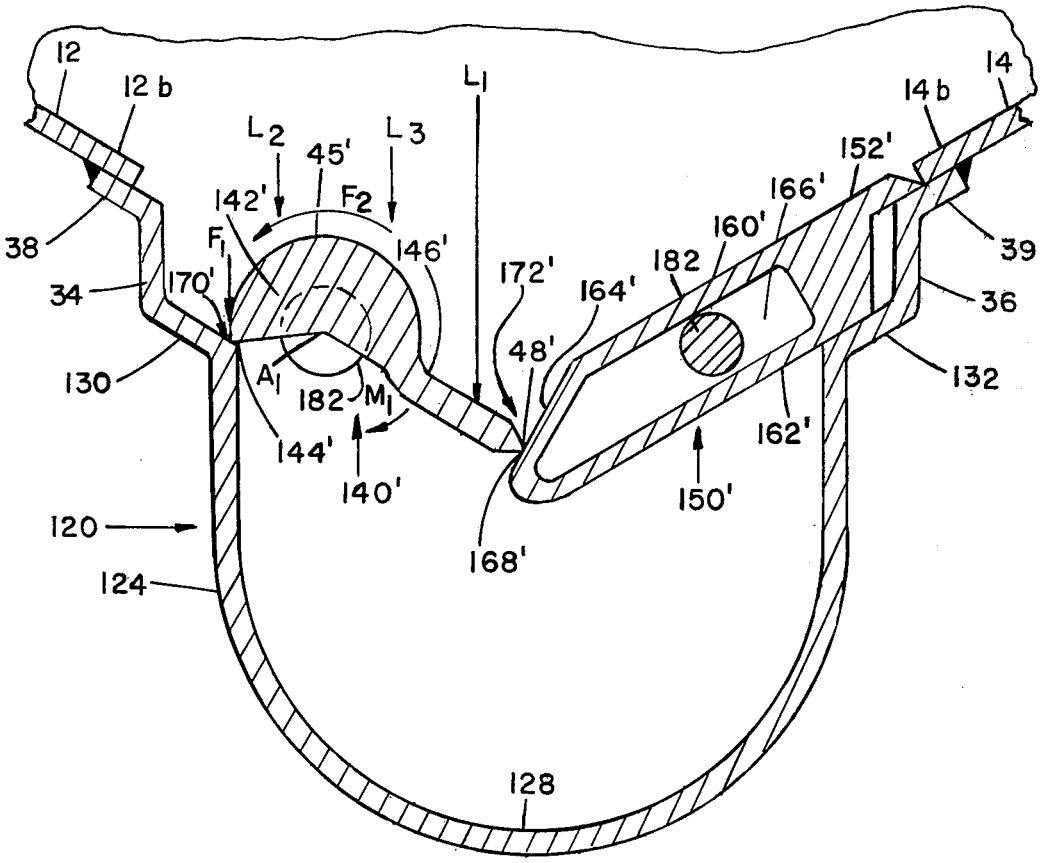
FIG. 8 is a sectional view looking in the direction of the arrows along the line 8—8 in FIG. 6.

A control valve and a valve seat are provided in each of the unloading compartments 176 and 178. Control valve 140 and valve seat 150 as shown in FIG. 6 are located in unloading compartment 176. Another control valve 140' and valve seat 150' constructed identical to control valve 140 and valve seat 150 are provided in unloading compartment 178. However, as shown in FIG. 8, control valve 140' is located adjacent to trough shoulder 130 which constitutes a body portion valve seat. Control valve 140' includes a body portion 142' and a moment portion 146' constructed in the same manner as body portion 142 and moment portion 146. Similarly a moment portion valve seat 150' is provided in compartment 178 mounted upon trough shoulder 132, including a mounting portion 152', upper and lower transverse legs 160' and 162', and a moment valve seat portion 164', all constructed in the same manner as moment portion valve seat 150.

As discussed in greater detail in regard to FIG. 2 the lading $L_2$ and $L_3$ acting on either side of the longitudinal axis of body portions 142 and 142' results in moments which are generally balanced, resulting in little tendency to rotate the control valves 140, 140' in either direction. However the lading $L_1$ acting on moment portions 146 and 146' creates a moment about the longitudinal axis of the body portion which tends to rotate the control valves 140, 140' into open position. This moment preferably is equal to or exceeds the force $F_1$ of any lading which must be displaced as the body portion moves toward open position, and the force of friction $F_2$ between the lading and the valve resisting rotation of the valve.

A pair of control shafts are attached to each control valve 140 and 140' with each pair of shafts extending in opposite directions along the longitudinal axis of each respective control valve body portion 142, 142'. Thus a first control shaft 180 (FIG. 9) attached to body portion 142 of valve 140 extends longitudinally through an opening 18*a* in end wall 18. A second control shaft 182 extends through a first opening 174*c* in partition 174 and through a first opening 20*a* (FIG. 14) in end wall 20 to the opposite side of the outlet. A similar control shaft 180' is attached to valve 140' which extends through a second opening 20*b* in end wall 20. A second control shaft 182' extends in the opposite direction from valve 140' through a second opening 174*d* in partition 174 and passes through a second opening 18*b* in the end wall 18.

Figure 9:
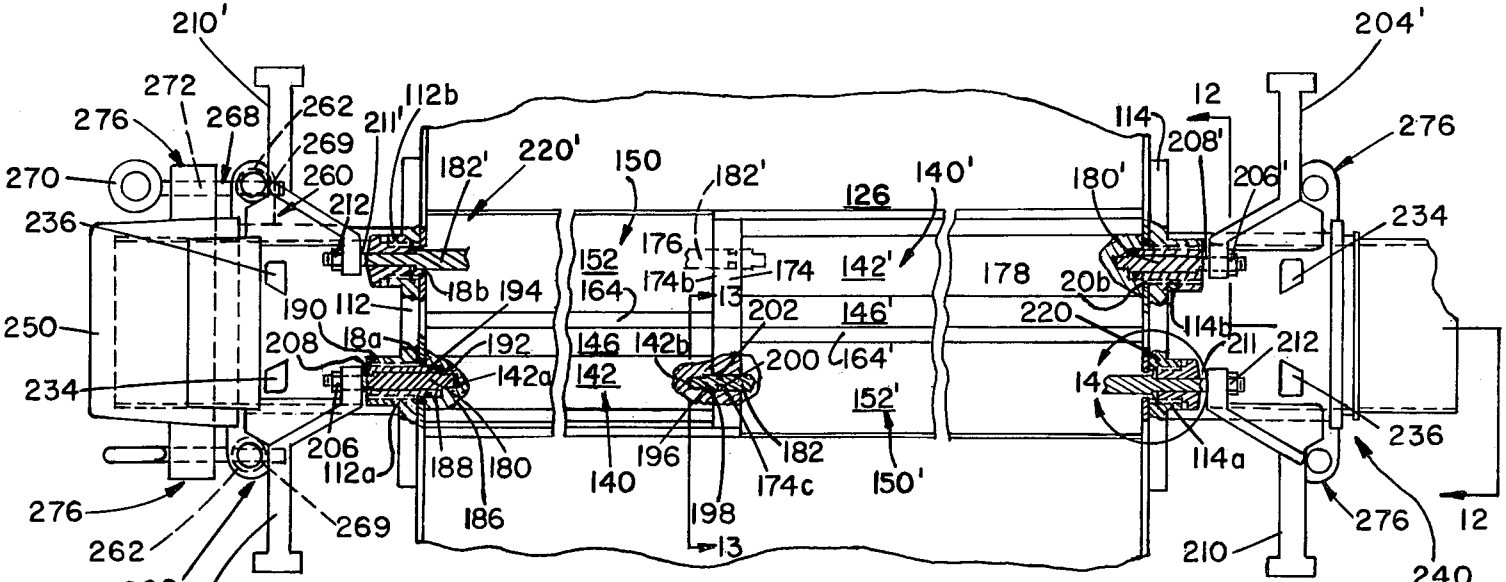
FIG. 9 is a plan view of the embodiment of the present invention shown in FIGS. 6–8 with parts broken away illustrating the mounting of the control shafts for the control valves of the outlet.
Figure 13:
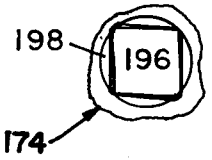
FIG. 13 is a view looking in the direction of the arrows along the line 13—13 in FIG. 9.
Figures 10, 14:
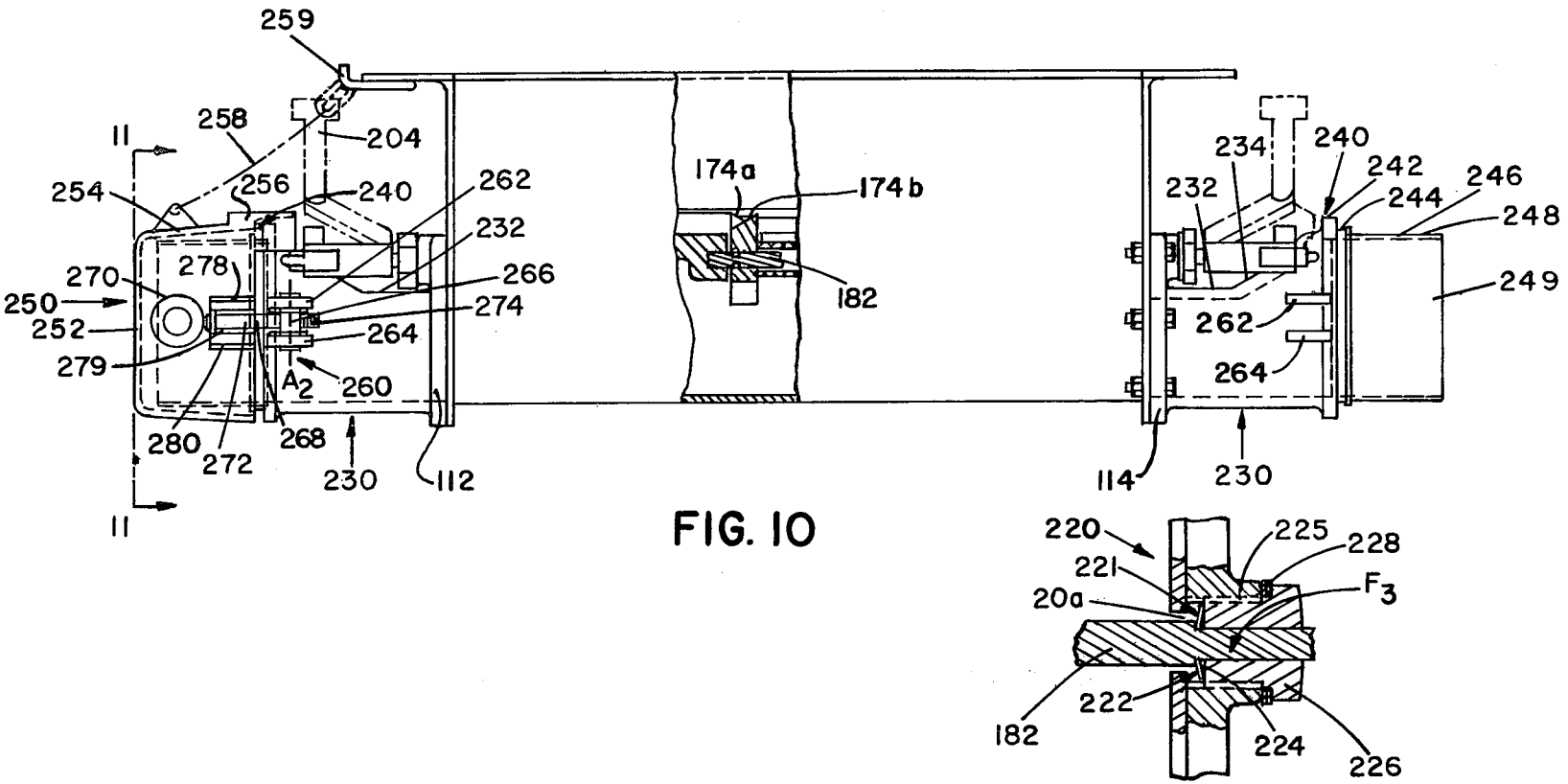
FIG. 10 is a side elevation view of the embodiment of the present invention shown in FIG. 9 with parts broken away, and the right hand end illustrating the structure prior to application of an end cap.
FIG. 14 is an enlarged view illustrating in greater detail the resilient device shown in FIG. 9.

End walls 18 and 20 are provided with vertical reinforcements 112 and 114 outward of the end walls (FIGS. 9 and 10). The reinforcements are enlarged at 112*a* and 112*b* and 114*a* and 114*b* in the vicinity of control shafts openings 18*a*, 18*b* and 20*a*, 20*b*.

As shown in FIG. 9, first control shaft 180 includes a square head 186 which engages a square opening 142*a* provided in body portion 142. A bushing 188 having a head 190 is threaded into end wall reinforcement 112*a* and opening 18*a* to allow rotation of shaft 180 and valve member 140. A groove 192 is provided into which an o-ring seal 194 is inserted between the bushing 188 and shaft 180. Shaft 182 also includes a square head 196 FIG. 13 which engages a square opening 142*b* provided at the opposite end of body portion 142. Shaft 182 becomes circular in cross section at 198. Shaft 182 is provided with a groove 200 in porton 174 into which an o-ring seal 202 is inserted.

As described above and as shown in FIG. 8 valve seat 150' includes a longitudinally extending hollow opening 166'. Shaft 182 extends longitudinally through hollow valve seat opening 166' and through end wall 20 (FIG. 9).

A handle 204 is provided for rotating shaft 180 which is held in place with a nut 206. Shaft 180 is preferably tapered at 208 to facilitate transmission of torque from handle 204 to shaft 180, and to maintain handle 204 spaced from bushing head 190. A similar handle 210 is provided for rotating shaft 182 at the other end of the outlet. Shaft 182 is tapered at 211 and handle 210 is held in place with a nut 212. This control valve 140 has a first control shaft 180 which extends to the near side of the outlet, through end wall 18, and a second control shaft 182 which extends to the far side of the outlet through end wall 20. Similarly control valve 140' has a first control shaft 180' extending to the near side of the outlet through end wall 20, and a second control shaft 182' which extends to the far side of the outlet through end wall 18. Control shafts 180' and 182' are mounted for rotational movement in the same manner as control shafts 180 and 182. Shafts 180' and 182' are preferably tapered respectively at 208' and 211'. Handles 204' and 210, held in place with nuts 206' and 212', are provided for moving control valve 140' between open and closed positions.

It is thus apparent that from the lefthand end of the outlet as viewed in FIGS. 6, 9 and 10, both control valves 140 and 140' can be opened and closed from this end of the outlet through rotation of respective shafts 180 and 182' by means of respective handles 204 and 210'. Similarly from the right end of the outlet, as viewed in FIGS. 6, 9, and 10 control valves 140 and 140' can be operated by rotation of respective shafts 180 and 182' by means of handles 210 and 204'. Thus each control valve 140 and 140' is independently operable from each end of the outlet.

It was mentioned above that it is preferred for the moment $M_1$ to be greater than any resisting forces $F_1$ and frictional resisting force $F_2$ tending to prevent rotation of the outlet as described above and illustrated in FIGS. 2, 7 and 8. In order to prevent the outlet valve from opening and to control the ease of opening of control valves 140 and 140', it is preferred to provide a resilient assembly indicated generally at 220 and shown enlarged in FIG. 14. Assembly 220 includes a resilient device 221 to resist rotation of the control valve shafts for the respective control valves. These resilient devices include a Belleville spring 222 engaging a formed shoulder 224 provided on shaft 182. Belleville spring 222 applies a frictional force F3 to shaft 182. A threaded plug 226 engages Belleville spring 222 to increase or decrease the frictional force F3 which spring 222 applies to shaft 182. A thrust washer 228 is provided to apply longitudinal thrusts resulting from rotating handle 210 to the end wall 20 rather than the shaft 182. A similar resilient assembly 220' is preferably provided at the other end of the outlet including a Belleville spring 222' to control the ease of rotation of control valve 140' through control valve shaft 182.

Discharge trough 120 is provided with end portions 230 (FIG. 10) located at opposite ends of the outlet. Each discharge portion 230 includes a foreshortened trough cross section 232 outboard of end walls 18 and 20. The foreshortened cross sections allow room at the ends of the outlet for rotation of handles 204, 210' and 204' (FIGS. 10 and 12). Discharge trough end portions 230 then include longitudinally extending inclined portions 234 (FIG. 10) extending upwardly and outwardly away from respective end walls 18 and 20.

A fitting portion 240 (FIG. 10) is provided for attachment of an unloading conduit or hose for unloading the lading and transferring the same to a suitable storage container (not shown). Fitting portion 240 includes three fittings 242, 244, 246 of different diameters. Fitting 246 is provided with an outwardly projecting extension 248 having an unloading opening 249 which is adapted to be received within the unloading hose or conduit.

A removable cap 250 is provided which is adapted to be attached to each discharge trough fitting portion 240. Cap 250 includes a body portion 252 which covers opening 249, and inwardly extending portion 254 which extends inwardly over extension 248. Cap 250 further includes an inner protrusion 256 which covers fittings 242 and 244 and is arcuately shaped as can be seen from FIG. 11. A cap chain 258 is attached to cap 250 (FIG. 10) and a cap chain mounting lug 259 is provided to store cap 250 whin it is removed from discharge trough fitting portion 240.

Figure 11:
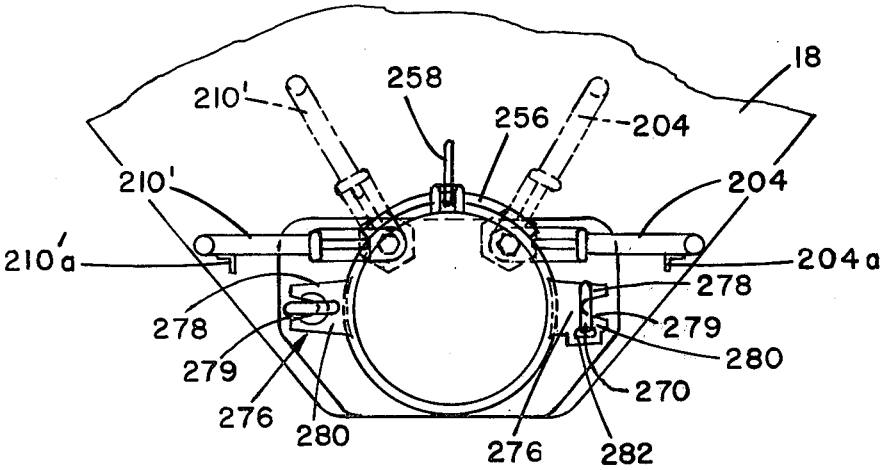
FIG. 11 is an end view looking in the direction of the arrows along the line 11—11 in FIG. 10.

Handles 204, 210' and 210, 104' must each be placed in the horizontally extending position illustrated in FIGS. 11 and 12 in order for cap arcuate portion 256 to move inwardly during application sufficiently for the cap 250 to assume the closed position covering fitting portion 240. In the horizontally extending position shown in solid lines in FIGS. 11 and 12, both of the outlet control valves 140 and 140' are in the fully closed position. When cap 250 has been removed, the handles are movable to the open positions illustrated in dotted lines in FIG. 11 for unloading the lading. A pair of stops 235 and 236 (FIG. 9) are provided on discharge trough end portion 230 to cease handle movement when valves 140 and 140' reach the full open position. In this position clearance is provided between the handles 204, 210' and 204', 210 and mounting flanges **18*a* and 20*a* (FIGS. 10 and 12). When the handles are again moved into the horizontally extending position shown in solid lines in FIG. 11, the cap 250 can be applied and moved into the closed position covering the discharge trough. Closed position stops 204*a*, 210'*a* (FIG. 11) and 204'*a*, 210*a* (FIG. 12) may be provided for the respective handles to engage in the closed position. This is particularly advantageous if the contour of body portion 142, and 142'** is such that the body portion edge does not seat on the body portion valve seat in closed position.

Cap 250 is retained in closed position by the cap retaining assembly indicated generally at 260. This cap retaining assembly includes a pair of vertically spaced lugs 262 and 264 (FIG. 10) on each side of the trough (FIG. 9) having a pin 266 (FIG. 10) extending vertically through the lugs. Pins 266 pivotally mount eye bolts 268 on either side of the discharge trough (FIG. 9). Eye bolts 268 include eyes 270 and a shaft portion 272 which is threaded at 274. Shaft threaded portion 274 engages a threaded opening 269 in pin 266. Mounting lugs 276 are provided on opposite sides of cap 250. Lugs 276 include upper and lower spaced portions 278 and 280 having an opening therebetween 279 (FIG. 11). Thus eye bolts 268 can be pivoted about the vertical axis $A_2$ (FIG. 10) defined by the center of pin 266 and rotated into the position shown in FIGS. 9 and 10. Eye bolts 268 can then be rotated by means of eye portion 270 to move threaded portions 274 relative to threaded openings 269 in pin 266 until eyes 270 engage lugs 278 and 280 to maintain cap 250 in the closed position. As shown in FIG. 11, a car seal may be inserted through eye bolt 270 and an opening 282 provided in cap locking lug 280.

OPERATION

In the operation of this embodiment, if it is assumed that it is desired to unload the lading from the lefthand side of the outlet as illustrated in FIGS. 6, 9 and 10, a car seal is first removed from opening 282 and the eye 270 of eye bolt 268. Eye bolts 268 are then rotated an amount sufficient that the eye bolts are moved out of engagement with cap lugs 278 and 280. The eye bolts 268 are then pivoted horizontally about the pin 266 to the open position. Cap 250 is then removed from discharge trough end portion 230 and placed on cap mounting lug 259. A suitable conduit or hose is then connected to one of the fittings 242, 244, or 256 located on fitting portion 240 of discharge trough end portion 230. If it is desired to unload the far compartment 178 first as is often the case, handle 210' is utilized to rotate shaft 182' to move control valve 140' from the position shown in solid lines in FIG. 8 into an open position wherein lading can pass through the first and second control valve discharge openings 170' and 172' into discharge trough 120. In the full open position handle 210' engages stop 236. If very accurate metering of the lading is desired, control valve 140' may be moved into a metering position wherein body portion edge 144' is spaced from body portion shoulder valve seat 130, allowing a controlled amount of lading to pass through first discharge opening 170' while plate edge 148' remains in engagement with or closely adjacent valve seat extension 168', substantially preventing lading from passing through control valve discharge opening 172'. After most or all of the lading is removed from compartment 178 of the outlet, unloading from the near compartment 176 of the outlet may take place by rotation of the handle 204 and shaft 180 to move control valve 140 to the open position, in which handle 204 engages stop 234 (FIG. 9). Control valve 140 is also movable into a metering position in the same manner as control valve 140'. If desired, the near compartment 176 may be unloaded first. Also if desired, at the end of the unloading operation both control valves 140 and 140' may be opened at the same time, and rotated back and forth to obtain complete cleanout of the lading. Effective cleanout of the lading is obtained because the unloading surfaces are inclined downwardly toward discharge trough 120. Control shafts 180, 180' and 182, 182' extend through hollow valve seats so that these shafts do not provide obstructions to trap ladings. Furthermore the lower surface 128 of discharge trough 120 extends horizontally to each end of the discharge trough and does not contain vertical or transverse projections which provide places where lading can hang up and become trapped in the outlet.

After the lading has been unloaded handles 204 and 210' are moved into the position shown in solid lines in FIG. 11 at which position control valves 140 and 140' are in the fully closed, seated position as shown in solid lines in FIGS. 7 and 8. If body portions 142 and 142' do not engage the respective body portion valve seats 130 and 132 in closed position, the handles 204 and **210'*a* engage stops 204*a* and 210'*a*. The cap 250 is removed from the lug 259 and placed on the discharge trough fitting portion 240. Protrusion 256 extends inwardly as shown in FIG. 10 and engages handles 204 and 210' to maintain the control valves 140 and 140'** in fully closed position for intransit movement and/or storage.

Unloading from the righthand side of the outlet as viewed in FIGS. 6, 9 and 10 is carried out in the same manner, by removing cap 250 and rotation of shafts 182 and 180' respectfully by means of handles 210 and 204'.

It is apparent that the closed position stop means may comprise the body portion engaging the body portion valve seat, or stops may be provided which are engaged by the handles, or lugs on the control shafts. Stop which engage when the control valve reaches the full open position are desirable, but not essential to the operation.

In general it is believed that the amount of friction applied to the control shafts by means of resilient assemblies 220 and 220' will be set at the conclusion of manufacture of the outlet and/or during installation, and further adjustment will not be required. However, in some instances it may be desirable to increase or decrease the frictional force applied by resilient devices 210, 210'. This is done by rotation of nuts 226, 226'. If for any reason one of the control valves 140 and 140' were to become wedged in the closed position and the operator was having difficulty moving the control valve into the open position, the nut 226 and 226' may be rotated outwardly to reduce the amount of friction applied to the control shaft 182 or 182' thus reducing the force resisting rotation of the control valve to the open position.

It will be noted that the control valves are mounted in the upper portion of discharge conduits 90 and 120. Thus the control valves and control shafts are less subject to damage caused by impacting of the outlet. Furthermore in the preferred embodiment the control shaft are mounted within the hollow valve seats 150, 150' to further protect the control shafts from damage to impact.

Also the discharge conduits attached to the fitting portions 240 of the discharge trough do not have to be rotated during unloading. Thus the operating torque necessary to open and close the control valve is greatly reduced in comparison to pneumatic outlets requiring such conduit rotation.

What is claimed is:

1. A container outlet for use on railway hopper cars, overland hopper trucks and/or intermodel hopper containers comprising:

a pair of transversely spaced side walls; the lower inner ends of the side walls defining an outlet discharge opening; a control valve rotatably mounted within said discharge opening; control valve including a body portion having a body portion longitudinal axis of rotation and a body edge which in closed position engages or is closely adjacent to a body portion valve seat located on a first side of said control valve; said control valve further including a moment portion extending transversely and eccentrically from said body portion; said moment portion having a moment portion edge which in closed position engages or is closely adjacent to a moment portion valve seat located on a second side of said control valve; said control valve moment portion extending eccentrically from said body portion a distance sufficient to define a moment portion moment arm about said body portion longitudinal axis, the combination of said moment portion moment arm and the force of gravity acting on the lading to be unloaded applied upon said moment portion creating a moment about the longitudinal axis of the body portion; said control valve being rotatably movable between said closed position and an open position wherein lading may pass through a first control valve discharge opening between said body portion and said body portion valve seat; and a second control valve discharge opening between said control valve and said moment portion valve seat; said moment tending to reduce the torque required to rotate said control valve into said open position; said moment portion valve seat including a downwardly inclined moment portion valve seat extension of sufficient length to allow rotation of the control valve to move said body portion edge to a metering position spaced from said body valve seat providing said first control valve discharge opening while at the same time said moment portion edge remains in engagement with or closely adjacent to said moment portion valve seat extension, thus allowing lading to discharge primarily through said first control valve discharge opening.

2. A container outlet for use on railway hopper cars, overland hopper trucks and/or intermodel hopper containers comprising:

a pair of transversely spaced side walls; said side walls rigidly attached to generally vertically extending, longitudinally spaced outlet end walls; the lower inner ends of the side walls and said end walls defining an outlet discharge opening; a pair of control valves longitudinally spaced, and rotatably mounted within said discharge opening, said control valves further being transversely spaced and located adjacent a different one of said side walls; each of said control valves including a body portion having a body portion longitudinal axis and a body portion edge which in closed position engages or is closely adjacent to a body portion valve seat located on a first side of each of said control valve, and a moment portion extending transversely and eccentrically from said body portion; said moment portion having a moment portion edge which in closed position engages or is closely adjacent to a moment portion valve seat located on a second side of each of said control valves; said body portion being generally symmetrical about said body portion axis such that lading forces due to gravity acting on the body portion on either side of said axis are generally balanced, resulting in little tendency to rotate the control valve in either direction; said control valve moment portion extending eccentrically from said body portion a distance sufficient to define a moment portion moment arm about the longitudinal axis of the body portion, the combination of said moment portion moment arm and the force of gravity acting on the lading to be unloaded applied upon said moment portion creating a moment about said body portion axis; each of said control valves being rotatably movable between said closed position, and an open position wherein lading may pass through a first control valve discharge opening between said body portion and said body portion valve seat and a second control valve discharge opening between said moment portion valve seat and said control valve; first and second control shafts attached to each control valve at opposite ends thereof along the respective longitudinal axis of each control valve body portion, said first control shaft extending in a first longitudinal direction through the adjacent outlet end wall, said second control shaft extending longitudinally in a direction opposite to said first direction and through the opposite outlet end wall; and means located externally of each end wall for rotating each control shaft whereby each of said control valves may be separately rotated from each end of said outlet; said moment tending to reduce the torque required to move said control shafts to said open position.

3. A container outlet for use on railway cars, overland hopper trucks and/or intermodel containers comprising:

at least one wall having an opening in the lower portion thereof defining an outlet discharge opening; a control valve rotatably mounted within said discharge opening; said control valve including a body portion having a body portion longitudinal axis of rotation and a body portion edge which in closed position engages, or is closely adjacent to, a body portion valve seat located on a first side of said discharge opening to substantially prevent lading discharge; said control valve further including a moment portion extending transversely and eccentrically from said body portion, said moment portion having a moment portion edge which in closed position engages or is closely adjacent to, a moment portion valve seat located on a second side of said discharge opening to substantially prevent lading discharge; said control valve moment portion extending eccentrically from said body portion a distance sufficient to define a moment portion moment arm about said body portion axis; said body portion being contoured such that lading forces due to gravity acting on the body portion on either side of said axis are generally balanced, resulting in little tendency to rotate the control valve in either direction; the combination of said moment portion moment arm and the force of gravity acting on the lading to be unloaded applied upon said moment portion creating a moment about said body portion axis; said moment tending to reduce the torque required to rotate said control valve into said open position; said control valve being rotatably movable between said closed position and an open position wherein lading may pass out of said outlet through said discharge opening during unloading.

4. A container outlet according to claim 3 wherein in open position lading may pass through a first control valve discharge opening located between said body portion and said body portion valve seat; and through a second control valve discharge opening located between said body portion and said moment portion valve seat, during unloading.

5. A container outlet according to claim 3 wherein the moment caused by the weight of the lading acting upon the moment portion of the control valve is approximately equal to the moment caused by the forces of friction opposing rotation of the control valve toward open position.

6. A container outlet according to claim 5 wherein a resilient device is provided having a bias which acts to counteract any excess of the moment caused by the weight of the lading acting upon the moment portion of the control valve over the moment caused by forces of friction opposing rotation of the control valve toward open position.

7. A bottom discharge outlet according to claim 3 wherein said body portion includes an arcuate upper surface.

8. A bottom outlet as set forth in claim 7 wherein the arcuate upper surface of the body portion forms an arcuate segment of at least around 60°.

9. A container outlet according to claim 3 wherein the upper surface of the body portion is curved to reduce the force of the weight of the lading opposing rotation of the valve to the open position.

10. A container outlet according to claim 3 wherein a shaft is provided to rotate said control valve.

11. A container outlet according to claim 10 wherein a resilient device is provided which engages said shaft and tends to prevent rotation of the shaft.

12. A container outlet according to claim 3 wherein said body portion valve seat comprises a portion of said side wall.

13. A container outlet according to claim 12 whrein said moment portion valve seat comprises a portion of said wall.

14. A container outlet for use on railway cars, over land hopper trucks and/or intermodel containers comprising:

at least one wall having an opening in the lower portion thereof defining an outlet discharge opening; a control valve rotatably mounted within said discharge opening; said control valve including a body portion having a body portion longitudinal axis of rotation and a body portion edge which in closed position engages, or is closely adjacent to, a body portion valve seat located on a first side of said discharge opening to substantially prevent lading discharge; said control valve further including a moment portion extending transversely and eccentrically from said body portion, said moment portion having a moment portion edge which in closed position engages or is closely adjacent to a moment portion valve seat located on a second side of said discharge opening to substantially prevent lading discharge; said control valve moment portion extending eccentrically from said body portion a distance sufficient to define a moment portion moment arm about said body portion axis; said body portion being generally arcuate, and lading forces due to gravity acting on the body portion on either side of said axis are generally balanced; resulting in little tendency to rotate the control valve in either direction; the combination of said moment portion moment arm and the force of gravity acting on the lading to be unloaded applied upon said moment portion creating a moment about said body portion axis; said moment tending to reduce the torque required to rotate said control valve into said open position; said control valve being rotatably movable between said closed position and an open position wherein lading may pass through a first control valve discharge opening located between said body portion and said body portion valve seat; and through a second control valve discharge opeing located between said body portion and said moment portion valve seat, during unloading.

15. A bottom outlet as set forth in claim 9 wherein the body portion includes an arcuate segment struck from a radius at the axis of rotation and the moment portion includes an outwardly extending generally flat portion integral with said arcuate segment.

16. A container outlet according to claim 14 wherein said body portion is segment shaped and wherein said body portion edge is defined by the juncture of the upper and lower surface of said segment.

17. A container outlet according to claim 16 wherein said segment shape is a segment of a circle.

18. A container outlet according to claim 17 wherein said segment portion is at least about 60°.

19. A container outlet for use on railway cars, overland hopper trucks and/or intermodel containers comprising:

at least one wall having an opening in the lower portion thereof defining an outlet discharge opening; a control valve rotatably mounted within said discharge opening; said control valve including a body portion having a longitudinal axis of rotation and a body portion edge which in closed position engages or is closely adjacent to, a body portion valve seat located on a first side of said discharge opening to substantially prevent lading discharge; said body portion being generally symmetrical about said body portion axis such that lading forces due to gravity acting on the body portion on either side of said axis are generally balanced, resulting in little tendency to rotate the control valve in either direction; said control valve further including a moment portion extending transversely and eccentrically from said body portion, said moment portion having a moment portion edge which in closed position engages or is closely adjacent to a moment portion valve seat located on a second side of said discharge opening to substantially prevent lading discharge; said control valve moment portion extending eccentrically from said body portion a distance sufficient to define a moment portion moment arm about said body portion axis; the combination of said moment portion moment arm and the force of gravity acting on the lading to be unloaded applied upon said moment portion creating a moment about said body portion axis; said moment tending to reduce the torque required to rotate said control valve into said open position; said control valve being rotatably movable between said closed position and an open position wherein lading may pass out of said outlet through said discharge opening; said outlet further including closed position stop means which engage when said control valve reaches said closed position.

20. A container outlet according to claim 19 wherein said body portion edge constitutes said closed position stop means.

21. A container outlet according to claim 19 wherein closed position stop means are provided which are engaged by handle means to rotate the control valve between open and closed position.

22. A pneumatic outlet for use on railway hopper cars, overland hopper trucks and/or intermodel hopper containers comprising:

a pair of transversely spaced side walls attached to longitudinally spaced end walls; the lower inner ends of said side walls and said end walls defining an outlet discharge opening; a discharge trough attached to the lower inner ends of the side walls which extends below said outlet discharge opening, longitudinally of the outlet; said discharge trough including a lower, discharge trough portion and an upper discharge trough portion; said upper discharge trough portion attached to said side walls; a control valve rotatably mounted within said discharge trough; said control valve including a body portion having a body portion longitudinal axis and a body portion edge which in closed position engages or is closely adjacent to a body portion valve seat located on a first side of said discharge opening, said control valve further including a moment portion extending transversely and eccentrically from said body portion; said moment portion having a moment portion edge which in closed position engages or is closely adjacent to a moment portion valve seat located on a second side of said discharge opening; said control valve moment portion extending eccentrically from said body portion a distance sufficient to define a moment portion moment arm about the longitudinal axis of the body portion; said body portion being contoured such that lading forces due to gravity action on the body portion on either side of said axis are generally balanced, resulting in little tendency to rotate the control valve in either direction; the combination of said moment portion moment arm and the force of gravity acting on the lading to be unloaded applied upon said moment portion creating a moment about the longitudinal axis of the body portion; said control valve being rotatably movable between said closed position and an open position wherein lading may pass through said discharge opening and into said discharge trough; said moment tending to reduce the torque required to move said control valve into said open position.

23. A pneumatic outlet according to claim 22 wherein said body portion is generally symmetrical about said body portion axis.

24. A pneumatic outlet according to claim 23 wherein said body portion is segment shaped.

25. A pneumatic outlet according to claim 23 wherein the upper surface of the body portion is curved to reduce the force of lading weight opposing rotation of the valve to the open position.

26. A pneumatic outlet according to claim 23 wherein said body portion valve seat comprises a portion of one of said side walls.

27. A pneumatic outlet according to claim 26 wherein said moment portion valve seat comprises a portion of the other of said side walls.

28. A pneumatic outlet according to claim 23 wherein said body portion valve seat comprises a portion of the discharge trough.

29. A pneumatic outlet according to claim 23 wherein said moment portion valve seat comprises a moment portion valve seat mounted upon said discharge trough.

30. A pneumatic outlet according to claim 22 wherein closed position stop means are provided which are engaged when said control valve assumes the closed position.

31. A pneumatic outlet according to claim 30 wherein said closed position stop means comprise said body portion edge and said body portion valve seat.

32. A pneumatic outlet according to claim 31 wherein said opening position stop means are provided which engage when said control valve reaches the full open position.

33. A pneumatic discharge outlet according to claim 22 wherein the moment caused by the weight of the lading acting upon the moment portion of the control valve is approximately equal to the moment caused by the forces of friction opposing rotation of the control valve toward open position.

34. A pneumatic discharge outlet according to claim 33 wherein a resilient device is provided having a bias which acts to counteract any excess of the moment caused by the weight of the lading acting upon the moment portion of the control valve over the moment caused by forces of friction opposing rotation of the control valve toward open position.

35. A pneumatic outlet for use on railway hopper cars, overland hopper trucks and/or intermodel hopper containers comprising:

a pair of transversely spaced side walls, said side walls rigidly attached to generally vertically extending, longitudinally spaced outlet end walls; the lower inner ends of the said walls and said end walls defining an outlet discharge opening; a discharge trough attached to the lower inner ends of the side walls which extends below said outlet discharge opening, longitudinally of the outlet beyond the opposite outlet end walls; said discharge trough including a lower, cylindrical discharge portion and a pair of upper, transversely extending mounting portions on each side of the discharge trough; a pair of control valves longitudinally spaced and rotatably mounted within said discharge opening, said control valves further being transversely spaced and located adjacent a different one of said trough mounting portions; each of said control valves including a body portion which is segment shaped having a body portion edge which in closed position engages or is closely adjacent to a body portion valve seat located on a first side of each of said control valve, and a moment portion extending transversely and eccentrically from said body portion; said moment portion having a moment portion edge which in closed position engages or is closely adjacent to a moment portion valve seat located on a second side of each of said control valve; said body portion being generally symmetrical about said segment portion axis such that lading forces due to gravity acting on the segment portion on either side of said axis are generally balanced, resulting in little tendency to rotate the control valve in either direction; said control valve moment portion extending eccentrically from said body portion a distance sufficient to define a moment portion moment arm about the longitudinal axis of the body portion, the combination of said moment portion moment arm and the force of gravity acting on the lading to be unloaded applied upon said moment portion creating a moment about the longitudinal axis of the body portion; each of said control valves being rotatably movable between said closed position; and an open position wherein lading may pass through a first control valve discharge opening between said body portion and said body portion valve seat, and second control valve discharge opening between said control valve and said moment portion valve seat into the discharge trough; first and second control shafts attached to each control valve along the longitudinal axis of the control valve body portion, said first control shaft extending in a first longitudinal direction through the adjacent outlet end wall, said second control shaft extending longitudinally in a direction opposite to said first direction and through the opposite outlet end wall means located at each end of the outlet for rotating each of said control shafts.

36. A pneumatic outlet according to claim 35 wherein said control valve seat is hollow, and wherein said second control shafts each pass through respective hollow moment portion valve seats in said outlet.

37. A pneumatic outlet according to claim 35 wherein a resilient device is provided engaging at least one of said first and second control shafts which tends to prevent rotation of the shaft engaged by the resilient means.

38. A pneumatic outlet according to claim 37 wherein said resilient device comprises Belleville springs attached to said shaft.

* * * * *

UNITED STATES PATENT AND TRADEMARK OFFICE

CERTIFICATE OF CORRECTION

PATENT NO. : 4,114,785
DATED : September 19, 1978
INVENTOR(S) : Richard H. Dugge It is certified that error appears in the above-identified patent and that said Letters Patent are hereby corrected as shown below:

Col. 1, line 35, insert a comma after "operator"; delete the comma after "makes".
Col. 2, line 25, "discharge" should read --discharged--.
Col. 3, line 59, delete "force".
Col. 4, line 43, delete "and".
Col. 5, line 6, "intermodel" should --intermodal--.
Col. 10, line 4, insert a comma after "FIG. 2".
line 49, "porton should read --portion--.
Col. 11, line 49, insert --210 and-- after "and".
Col. 12, line 3, "whin" should read --when--.
line 28, delete the comma after "142".
Col. 13, line 44, "210'a" should read --210'--.
Col. 14, claim 1, line 26, "intermodel" should read --intermodal--.
line 31, insert --said-- after "discharge opening;".
Col. 15, claim 2, line 4, "intermodel" should read --intermodal--.
claim 3, line 61, "intermodel" should read --intermodal--.
Col. 17, claim 14, line 5, "intermodel" should read --intermodal--.
claim 15, line 46, "claim 9" should read --claim 14--.
Col. 18, claim 22, line 39, "intermodel" should read --intermodal--.
Col. 19, claim 35, line 61, "intermodel" should read --intermodal--.

Signed and Sealed this

Sixth Day of February 1979

[SEAL]

Attest:

RUTH C. MASON
Attesting Officer

DONALD W. BANNER
Commissioner of Patents and Trademarks